United States Patent [19]

Bartok

[11] Patent Number: 4,923,259

[45] Date of Patent: May 8, 1990

[54] ADJUSTABLE KEYBOARD DRAWER ASSEMBLY

[75] Inventor: Stephen Bartok, Rancho Palos Verdes, Calif.

[73] Assignee: MicroComputer Accessories Incorporated, Los Angeles, Calif.

[21] Appl. No.: 236,421

[22] Filed: Aug. 25, 1988

[51] Int. Cl.[5] ..... A47B 21/00

[52] U.S. Cl. ..... 312/208; 312/323; 108/143

[58] Field of Search ..... 312/323, 242, 208; 108/5-7, 102, 143

[56] References Cited

U.S. PATENT DOCUMENTS

| | | | |
|---|---|---|---|
| D. 290,199 | 6/1987 | Hampshire . | |
| D. 292,352 | 10/1987 | Hampshire et al. . | |
| 2,752,219 | 6/1956 | Yonkers | 312/323 X |
| 2,809,085 | 10/1957 | Fall | 312/323 |
| 2,856,450 | 10/1958 | Padgett et al. | 312/323 X |
| 4,145,097 | 3/1979 | Ness et al. . | |
| 4,316,082 | 2/1982 | Fritz . | |
| 4,483,572 | 11/1984 | Story . | |
| 4,496,200 | 1/1985 | Hagstrom et al. . | |
| 4,576,578 | 3/1986 | Parker et al. . | |
| 4,644,875 | 2/1987 | Watt | 108/143 X |
| 4,688,862 | 8/1987 | Fowler et al. . | |
| 4,695,104 | 9/1987 | Lederman . | |
| 4,709,971 | 12/1987 | Leeds et al. . | |
| 4,709,972 | 12/1987 | Leeds et al. . | |
| 4,718,740 | 1/1988 | Cox . | |

OTHER PUBLICATIONS

Pages 75 and 84, United Stationers Supply Company, 2200 East Golf Road, Des Plaines, Illinois 60016, Publication Date 1988.

Pages 46, 211, 215, and 217, Inmac, 2465 Augustine Drive, P.O. Box 58031, Santa Clara, CA. 95052-8631. Publication Date Nov. 1987.

Sell Sheet, Steelcase, The Office Environment Co., Grand Rapids, MI 49501.

Sell Sheet Metal Keyboard Drawers and Stands, MicroComputer Accessories, Inc., 5405 Jandy Place, P.O. Box 66911, Los Angeles, CA 90066-0911, Publication Date 1986.

Sell Sheet, Keyboard Drawers and Stands, MicroComputer Accessories, Inc., 5405 Jandy Place, P.O. Box 66991, Los Angeles, CA 90066-0911, Publication Date 1986.

Sell Sheet, The Typerite Keyboard Drawers, MicroComputer Accessories, Inc., 5405 Jandy Place, P.O. Box 66991, Los Angeles, CA 90066-0911, Publication Date 1986.

Sell Sheet, Underboard Keyboard Desk, MicroComputer Accessories, Inc., 5405 Jandy Place, P.O. Box 66991, Los Angeles, CA 90066-0911, Publication Date 1986.

*Primary Examiner*—Joseph Falk

*Attorney, Agent, or Firm*—Richard B. O'Planick

[57] ABSTRACT

An adjustable drawer assembly is disclosed comprising first and second arm members (28,30) having inward ends pivotally journaled to a housing member (4), and a carriage plate (20) for transporting the arms from a storage position within the housing to an operable position in front of the housing. Distal ends of the first and second arms include meshing teeth (44,73) for locking the arms together whereby preventing downward pivotal movement of the arms relative to the housing. A third arm member (78) is provided in support of to a keyboard support surface (104). The third arm is pivotally connected to the second arm member, whereby enabling the keyboard support surface to pivot into alternative angular attitudes. Meshing gear racks (42,90) are provided on the second and third arm members for inhibiting pivotal motion, and actuation means (92) is provided for simultaneously releasing the meshing teeth racks whereby enabling coincidental vertical and angular repositionment of the keyboard support surface.

7 Claims, 6 Drawing Sheets

ADJUSTABLE KEYBOARD DRAWER ASSEMBLY

BACKGROUND OF THE INVENTION

1. Field of the Invention

The subject invention relates generally to support surface assemblies for keyboard components of computer systems, and more specifically to such assemblies which function to transport a computer keyboard from a storage position within a housing to an operable second position suitable for use by the keyboard operater.

2. The Prior Art

Computer system work stations typically include a work surface designed to support a computer terminal and keyboard pad. Since the work surface may be used for non-computer activities, it is often desirable for such work stations to include apparatus for maintaining the keyboard in a storage location for non-use periods, and transporting the keyboard into an operable second position when computer use is contemplated. Ergonomically, it is desirable for such apparatus to be easy to operate, adjustable in presenting the keyboard to the operator in an optimal position and attitude, and be safe for its intended use. The industry's attempts to achieve a suitable apparatus for accomplishing the above summarized objectives have centered around drawer assemblies which transport a keyboard computer component from a storage location within a computer terminal supporting housing, to a position in front of the housing for use by the operator. For example, U.S. Pat. Nos. 4,483,572 and 4,496,200 disclose drawers for transporting a keyboard component from a storage housing (which supports a video terminal) to a position in front of the work surface accessible to a computer operator.

While the drawers specified in the above-identified-patents work well, they fail to satisfy the needs of the industry. First, the drawers offer a limited number of keyboard positions, and therefor do not provide an operator with a wide range of adjustment alternatives. Secondly, these known drawer assemblies function merely to extend and retract the keyboard, and do not offer the capability to angularly rotate the keyboard about its longitudinal axis. Optimal positioning of the keyboard to suit the comfort of the operator is therefor not possible.

SUMMARY OF THE PRESENT INVENTION

The subject invention overcomes the deficiencies in presently available drawer assemblies by providing a keyboard drawer assembly which is capable of adjustment in relatively fine vertical increments and which is further capable of angular adjustment.

The adjustable drawer assembly comprises first and second arm members extending along each side of a keyboard support surface, pivotally journalled to a housing. The first and second arm stretch, disposed above and below each other, respectively, are further connected to carriage means which transport the arms from a storage position within the housing to an operable position in front of the housing. Disposed at distal ends of the first and second arms are racks of meshing teeth which, when in meshing engagement, prevent downward pivotal movement of the arms relative to the housing.

A third arm member is further provided along each side, attached to the keyboard support surface. The third arm is pivotally connected to the second arm, enabling the keyboard support surface to pivot into alternative angular attitudes. Also provided are meshing gear racks on the second and third arm members for inhibiting pivotal motion, and actuation means for simultaneously releasing the meshing teeth, whereby enabling conincidental vertical and angular repositionment of the keyboard support surface.

Accordingly, it is an objective of the present invention to provide an adjustable keyboard drawer assembly capable of vertical and angular repositionment of a computer keyboard component.

A further objective is to provide a keyboard drawer assembly having simultaneously actuated vertical and angular adjustment actuation.

Still a further objective is to provide a keyboard drawer assembly capable of making relatively fine vertical and angular adjustments.

Yet a further objective is to provide a keyboard drawer assembly which is self-locking in the downward direction and self-releasing in the upward direction.

Another objective of the present invention is to provide a keyboard drawer assembly for repositioning a keyboard component at any position within a relatively large operational envelope to suit the comfort of the keyboard operator.

A still further objective is to provide assembly which is inexpensive to manufacture, easy to assemble, and convenient to operate.

These, and other objectives, which will be apparent to those skilled in the art, are achieved by a preferred embodiment which is described in detail below, and which is illustrated in the accompanying drawings.

DESCRIPTION OF THE PREFERRED EMBODIMENT

Figure 3:
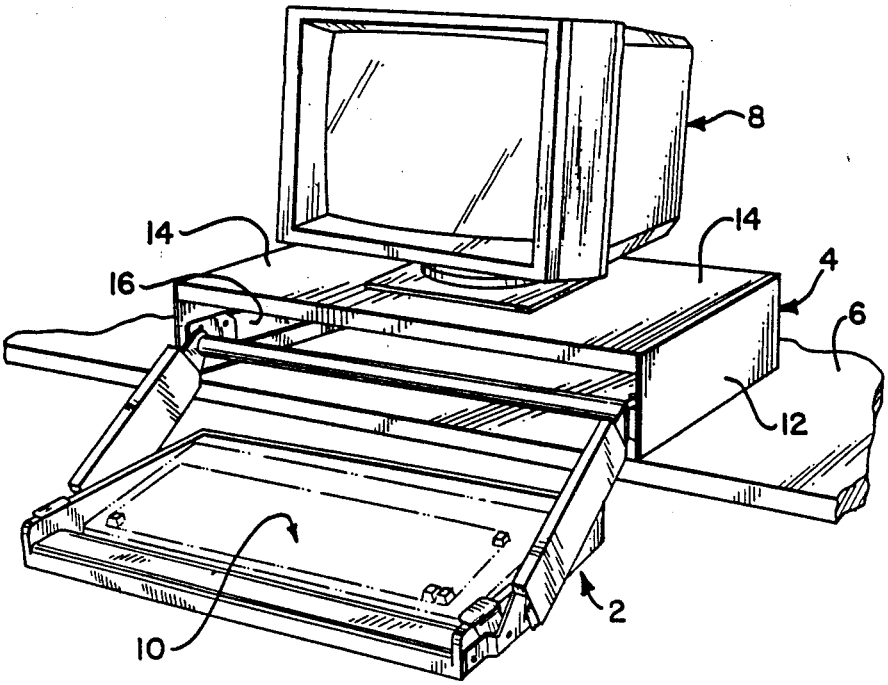
FIG. 3 is a three dimensional view of a typical application with the drawer open and in the down positon.
Figure 4:
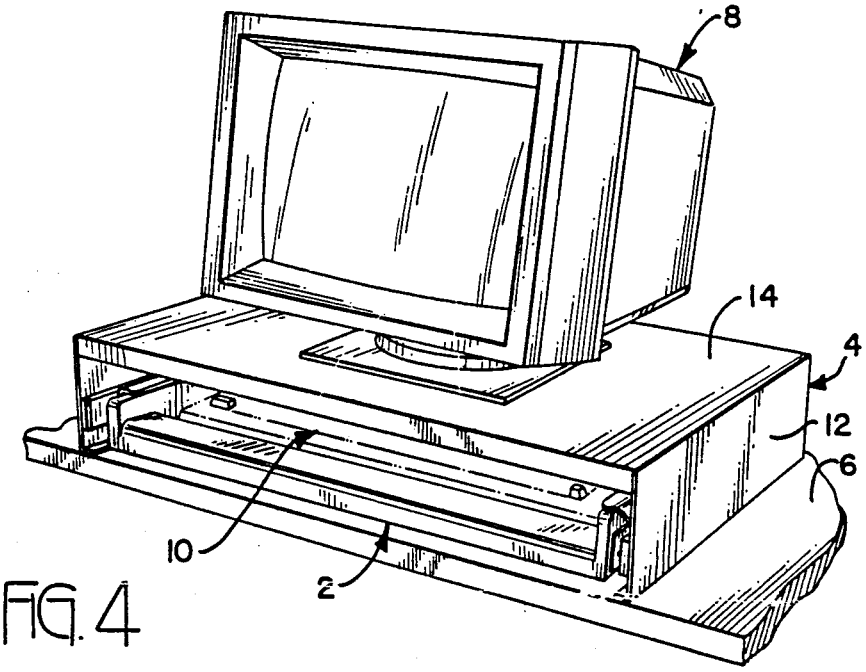
FIG. 4 is a view as in FIG. 3, but with the drawer closed.

Referring first to FIGS. 3 and 4, the subject keyboard drawer assembly 2 is shown extending from a support housing 4, which is situated on the top of a work station 6. The housing 4 is adapted having vertical sides 12 and a horizontal top surface 14 to support the video terminal 8 of a computer system, while a keyboard component 10 is positioned upon the drawer assembly 2. FIG. 3 illustrates the drawer assembly 2 in the extended position, as when the computer system is in use. FIG. 4 shows the drawer assembly 2 in the retracted or storage position within housing 4 as when the computer system is not in use.

Figure 1:
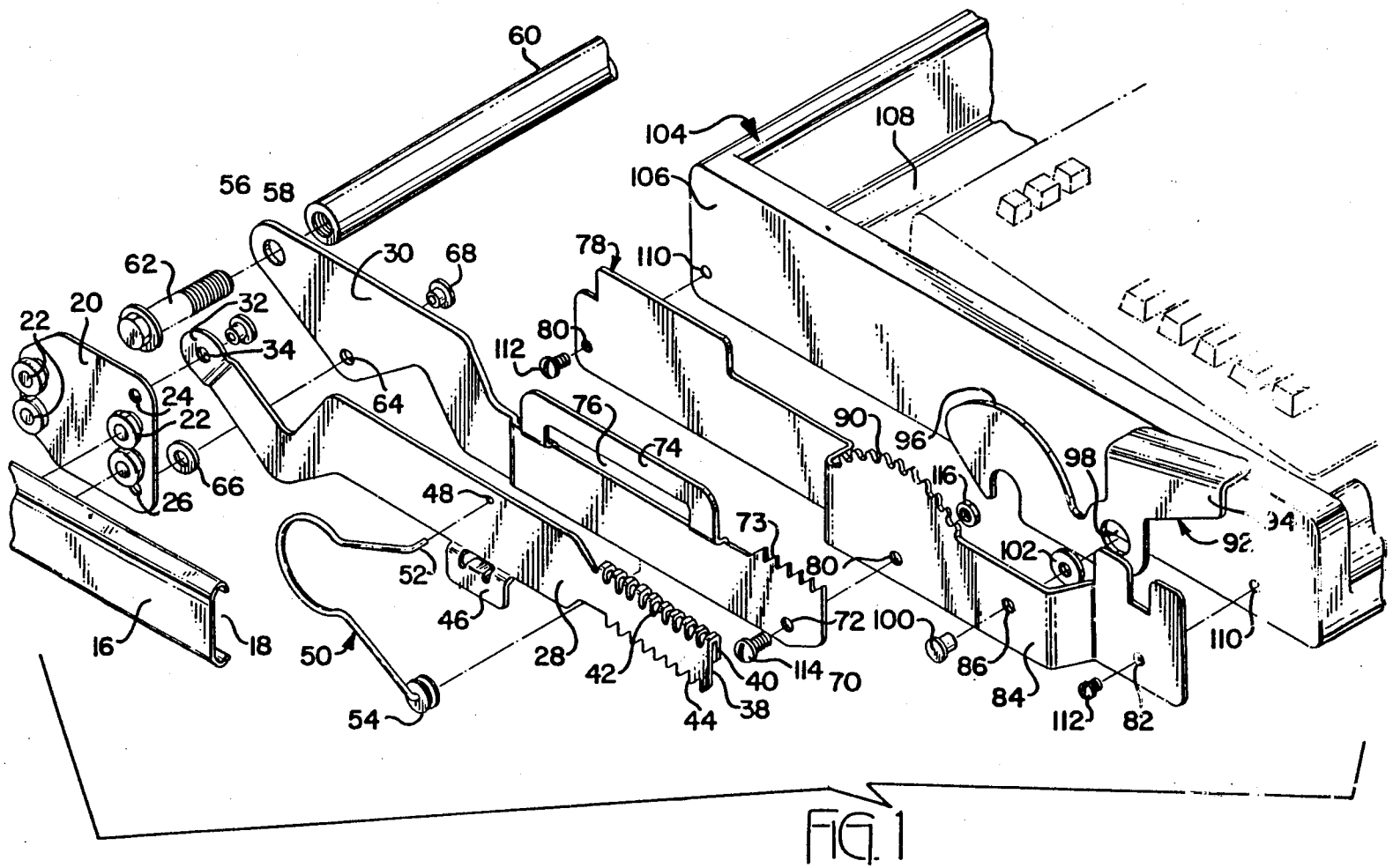
FIG. 1 is an exploded three dimensional view of the left side drawer assembly, as seen from the left front of the opened drawer.
Figure 2:
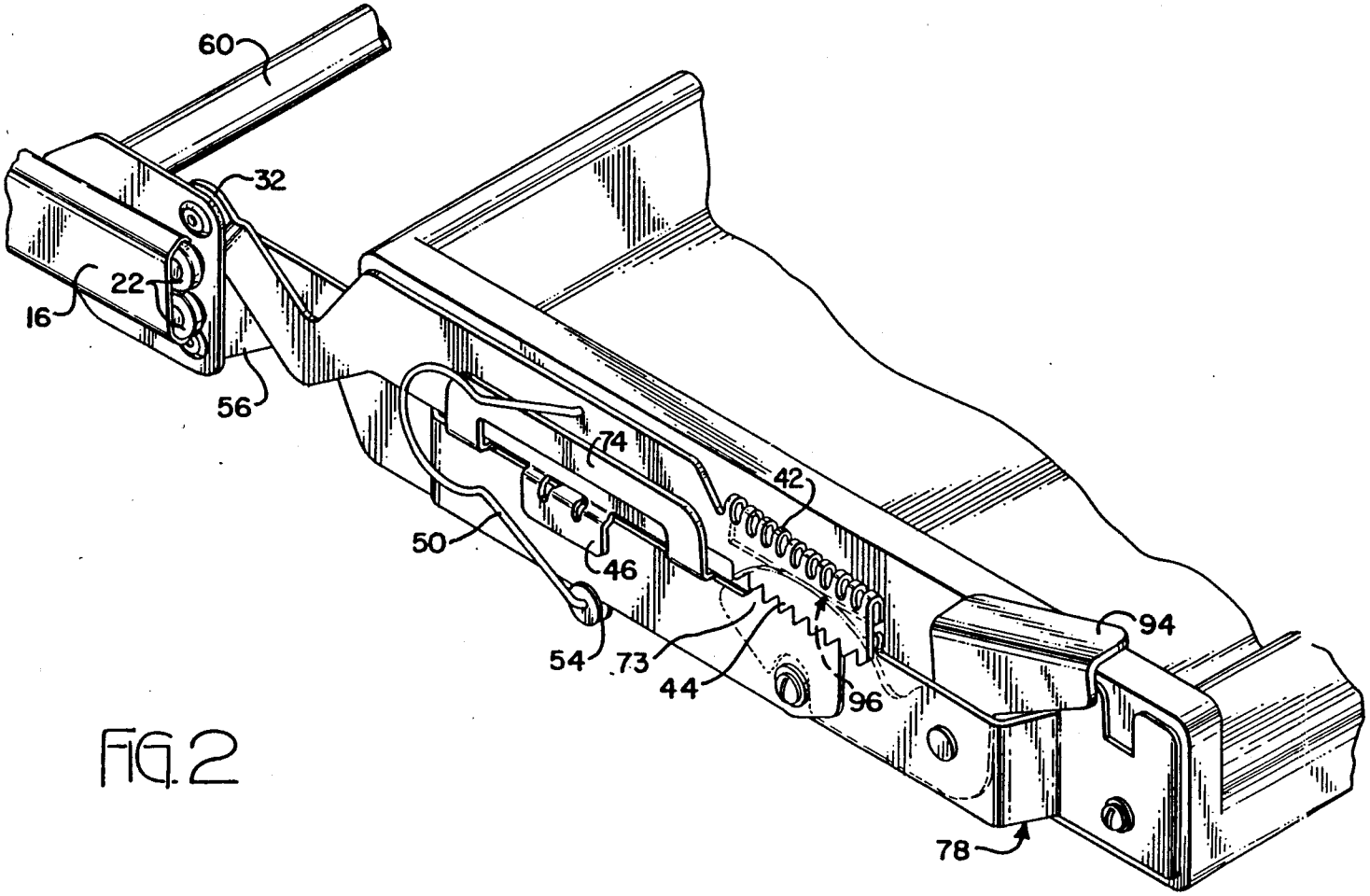
FIG. 2 is an assembled view of FIG. 1.

With reference now to FIGS. 1 and 2, the drawer assembly 2 comprises left and right side indentical subassemblies, the left side of which being illustrated and described below. The subassembly includes a guide track 16 which is mounted along an inwardly facing surface of housing side 12 (FIG. 3). The guide track is formed to provide a longitudinally extending channel 18 in which a carriage plate 20 is slideably mounted. Plate 20 is adapted having four outwardly directed rotatable plastic buttons 22 which reside within and roll along channel 18. Assembly apertures 24 and 26 extend through carriage plate 20 positioned as illustrated.

An upper arm 28 and a lower arm 30 are connected to an inward facing side of carriage plate 20. At an inward end 32 of upper arm 28 is an assembly aperture 34, and fastener 36 attaches through apertures 32 and 24 to connect arm 28 to plate 20. At a distal end 38 of arm 28 is a formed over rim segment 40 extending along an upper edge. Segment 40 is adapted to define upward directed tooth projections 42 along the upper edge thereof, and a rack of downward directed locking teeth 44 along a lower edge. Downward directed teeth 44 are of saw-tooth configuration, as shown.

Positioned at the intermediate portion of arm 25 and depending downwardly therefrom is a slide flange 46 which is offset outwardly from the plane of arm 28. A formed spring member 50 has an upper free end 52 captured within an aperture 48 through the arm member 28, and a rotatable button 54 is attached to the lower free end of spring member 50.

With continued reference to FIGS. 1 and 2, the lower arm 30 is shown to have an assembly aperture 58 at an inner end 56, for assembly to a transverse, internally threaded stabilizer bar 60 which connects the lower bars on opposite sides of the drawer assembly. The connection between lower arm 30 and bar 60 is effected by bolt 62 which extends through aperture 56 and into the end of the internal threaded bore of bar 60.

Pivotal connection of arm 30 to carriage plate 20 is accomplished by washer 66 and fastener 68 extending through aperture 64. The outward end 70 of arm 30 is distal from the pivot attachment. An assembly aperture 72 extends through arm 30 proximate end 70. A further segment of upward directed locking teeth 73 are located along an upper edge of arm 30 at end 70. Midlength of arm 30 and extending upwardly is guide bracket 74 which defines an elongate guide slot 76 with the upper edge of arm 30 for receipt of, as will be apparant, the dependent guide flange 46 of arm 28.

A third arm, support arm 78, is provided in the subject assembly having assembly apertures, 80 and 82, in opposite ends. Arm 78 further is configured having an outwardly offset medial projection 84 through which additional assembly apertures 86,88 extend. Positioned along a top edge of medial projection 84 is an arcuately profiled rack of locking teeth 90, positioned and shaped to mesh with teeth 42 of arm 28 in the manner described below.

An actuation lever plate 92 is provided having an upwardly inclined handle at an outward end, and an arcuate upwardly directed engagement flange 96 at an inward end. Assembly aperture 98 is provided by which lever plate 92 is assembled to arm 78 by washer and screw 100, 102. The connection between lever plate 92 and arm 78 is pivotal such that upon downward and upward movement of handle 94, causes resultant but oppositely directed movement of engagement flange 96.

As shown in FIG. 1, a keyboard support drawer member 104 of generally flat, rectangular configuration is a part of the subject invention. The member 104 has vertical sides 106 and a recessed central surface 108 adapted to support the keyboard component of a computer system. It will further be appreciated that the arm hardware illustrated in FIG. 1 and described above is assembled to the left side of the member 104, and like identical hardware is assembled to the right side (not shown). Assembly of the arm mechanism will be explained below.

Referring to FIGS. 1 and 2, the carriage plate 20 is slideably mounted within guide channel 18 and is free to move therealong from a storage location within housing 4 (FIG. 3) to a forward second position when the subject drawer assembly is to be used. Upper arm 28 is pivotally connected to plate 20 and pivots vertically about a pivot axis represented by fastener 36. Similarly, arm 30 is pivotally affixed to plate 20 and pivots vertically about pin 68. The axis of rotation of arms 28 and 30 thus both extend through the carriage plate 20 but are offset and disposed above and below each other.

The third arm member 78 is pivotally secured to the lower arm 30, and rotates angularly about pin 114. The pivotal actuation lever 92 is rotatably mounted to the third arm 78 and pivots about pin 100. The third arm 78 in turn is fixedly secured to the keyboard support member 104 by screws 112 and rotates therewith about pin 114 relative to arm member 30.

Spring member 50 has its upper free end 52 secured within aperture 48 of arm 28 and the rollar button 54 affixed to the spring lower end rotatably travels against a bottom edge of the lower arm 30. So positioned, the spring member serves to hold the upper arm 28 and-lower arm 30 nominally together in tension as the arms pivot unitarily and move into and out of locking engagement, and further to automatically bring the arms back into locking engagement When the actuation lever 94 is released.

Figure 5:
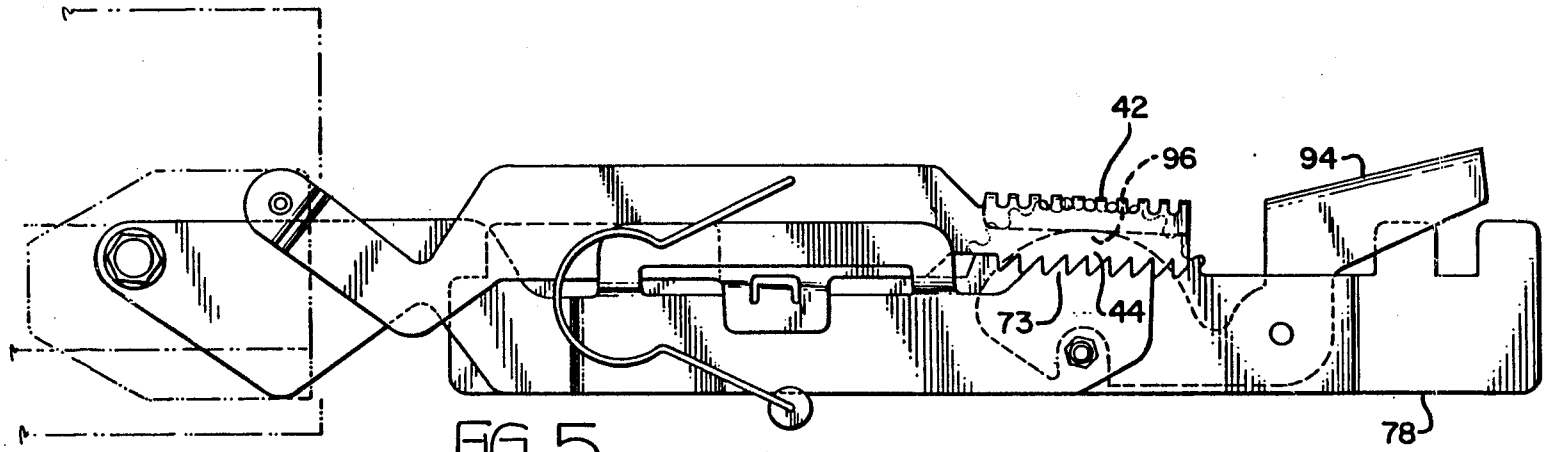
FIG. 5 is an end view of the left drawer assembly.
Figure 6:
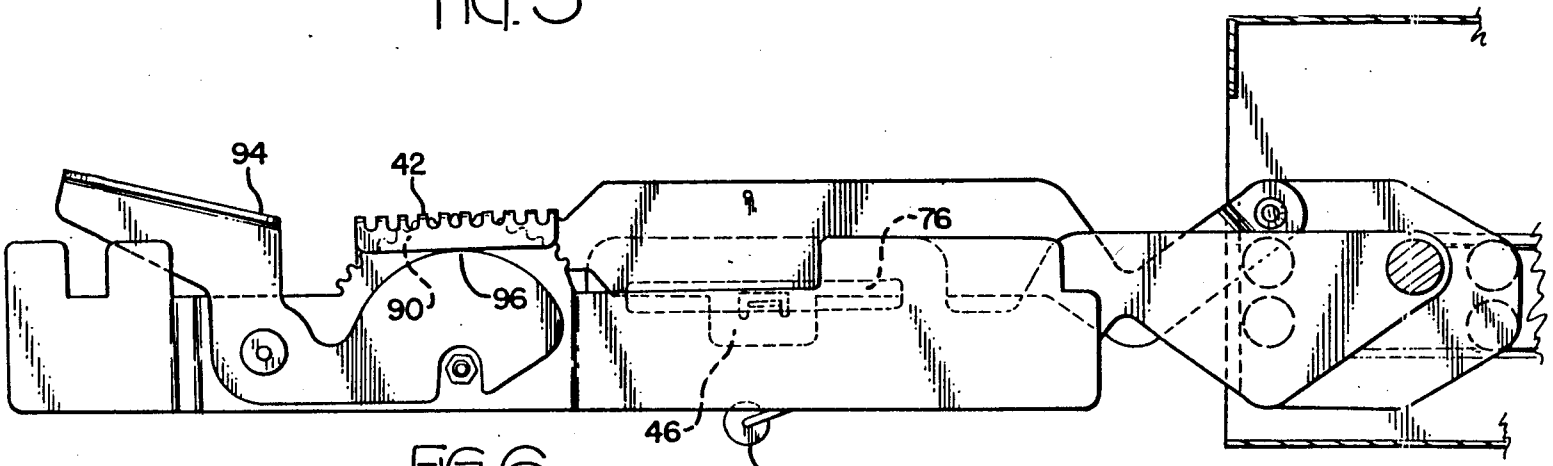
FIG. 6 is an inside view of the left drawer assembly.

As will be appreciated from a combined consideration of FIGS. 2, 5, and 6, in the assembled condition, the upper flange 40 of upper arm 28 is positioned above the arcuate gear rack 90 of third arm 78, and flange teeth 42 mesh with rack 90 in locking engagement. The downward directed teeth 44 of upper arm 28 are positioned above the upward rack of teeth 73 of lower arm 30 and mesh therewith in locking engagement. The arcuate engagement flange 96 of lever member 92 is disposed beneath the lower free edge of formed flange 40 in distal proximity. Spring member 50 draws the upper and lower arms 28,30 together, whereby the keyboard assembly is automatically maintained in a stable and locked condition.

With arms 28 and 30 extended from housing 4 as seen in FIG. 3, the keyboard 10 is accessible above the lap of the operator and is held in fixed position by the interlocked arms 28, 30, and 78. Pivotal movement of arms 28,30 downward about their respective connections to plate 20 is inhibited by the meshing engagement between teeth 73 and 44. With their ends secured together, and their respective pivot axis offset, the arms 28,30 cannot pivot downward and keyboard member 104 is maintained at a fixed vertical location relative to the operator. The sawtooth shape of the teeth 73 and 44 serve to mesh tightly and any downward directed force on keyboard support member 104 only serves to force the meshing teeth into tighter engagement, whereby acting to securely stabilize the member 104 from inadvertant and unsafe downward motion which could otherwise injure the legs of the operator.

Upward movement of keyboard support member 104 however is not prohibited since, by the configuration of the assembly mechanism, upward pressure on member 104 forces teeth 73 and 44 out of meshing engagement, whereby enabling arms 28 and 30 to pivot upward. Hence, inadvertant upwardly directed contact against member 104, initiated by the operator's legs, for instance, will not result in injury but merely cause disengagement between arms 28,30 and their upward pivotal relocation.

Figures 7, 8:
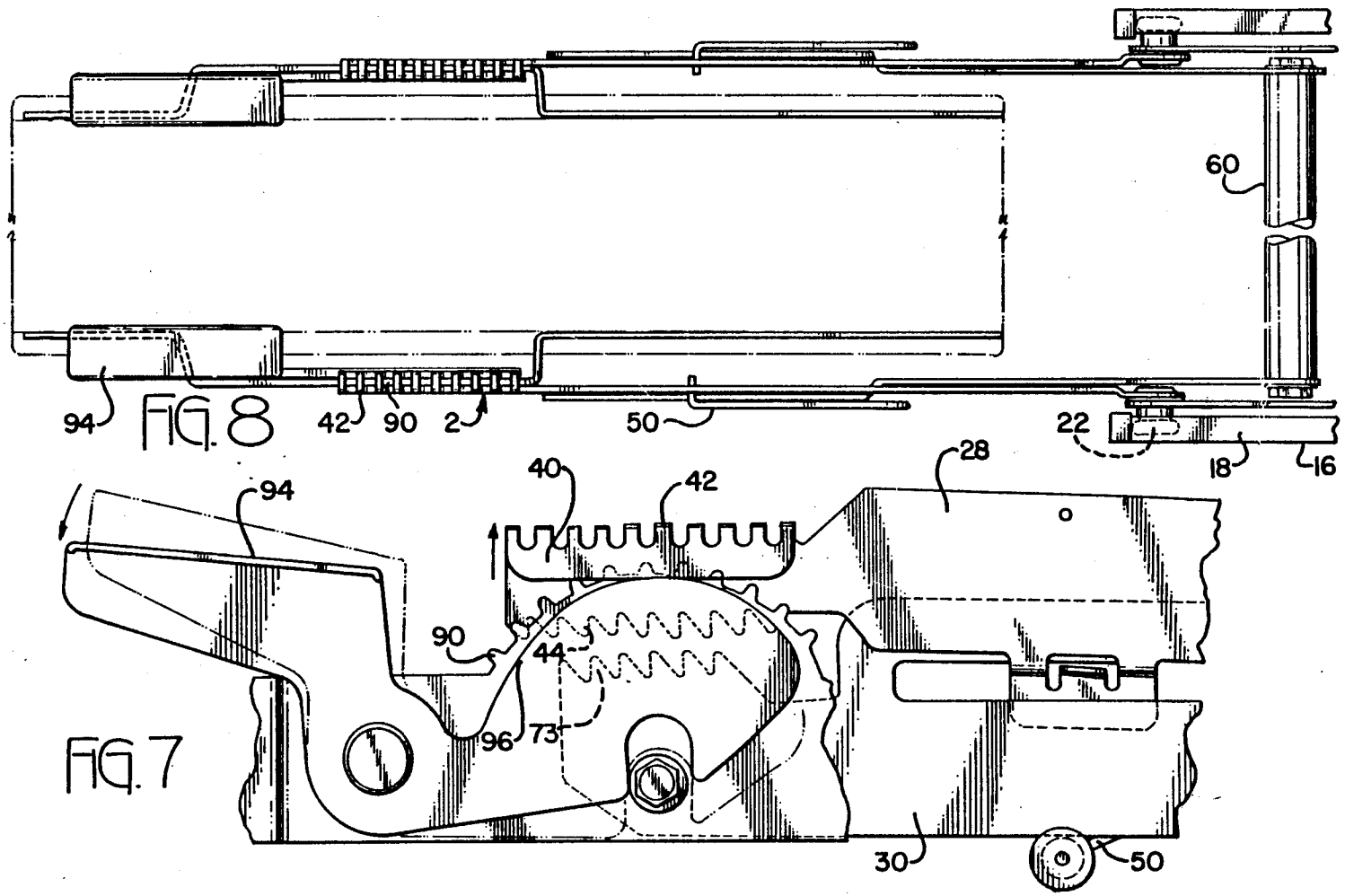
FIG. 7 is a detail view of FIG. 6 showing the adjustment lever depressed and the upper and lower arm teeth seperated.
FIG. 8 is a top plan view of the drawer assembly.

FIG. 7 illustrates the unlocking of the subject assembly for repositionment of the keyboard support surface. As shown, the actuation lever 94 (and its corresponding counterpart on the opposite side of the assembly, which is not shown) is depressed causing the engagement surface 96 to pivot upwardly and engage upper arm flange 40. Resultant upward movement of upper arm 28 relative to lower arm 30 operates to disengage meshing teeth 42,90, and meshing teeth 44,73. The two arms 28,30, so separated, are accordingly free to pivot about their respective pivot axis in the vertical direction relative to the housing 4 (FIG. 3). The keyboard component can thereby be adjusted vertically to suit the comfort of the operator.

When lever 94 is released, the spring member shown in FIG. 7 draws arms 28,30 together, re-establishing meshing engagement between the teeth racks 42,90, and 44,73, automatically locking the drawer assembly in its new position. The saw tooth configuration of teeth 44,73, biased in the direction shown in FIG. 7, inhibit downward pivotal movement of arm 28,30 when teeth 44,73 are engaged. Upward movement, however, for safety reasons, is not so prevented. Because the pivot axis of arms 28,30 at the housing are offset, upward force on arms 28,30 will initiate upward pivotal motion which serves to disengage teeth 44,73. Thus, the subject assembly is self-locking in the downward direction but self-releasing in the upward.

Also, it will be appreciated from FIG. 7 that, depending on the vertical position of arms 28,30 relative to housing 4 (see FIG. 3), the point at which teeth 42,90, and 44,73 mesh relative to each other will vary. By adapting racks 42,44,73 to extend a substantial segment of their respective arm members, a large range of vertical movement of arms 28,30 is facilitated. Thus, the keyboard support assembly can raise or lower the keyboard component approximately 5 inches.

Figure 9:
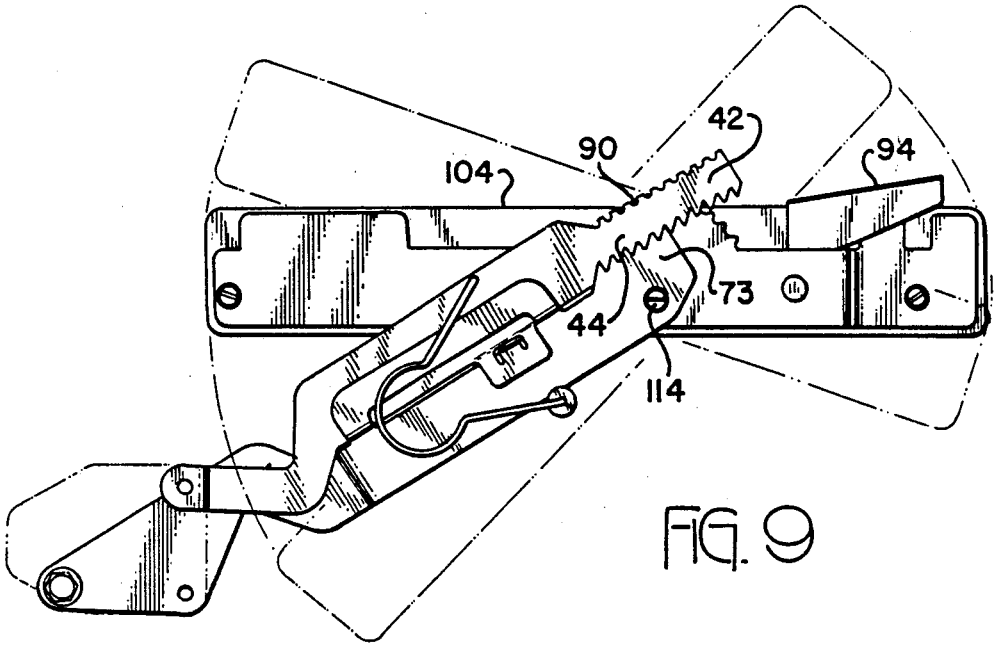
FIG. 9 is a left end view showing the drawer in the up position. The limits of the drawer rotation are shown in phantom line.
Figure 10:
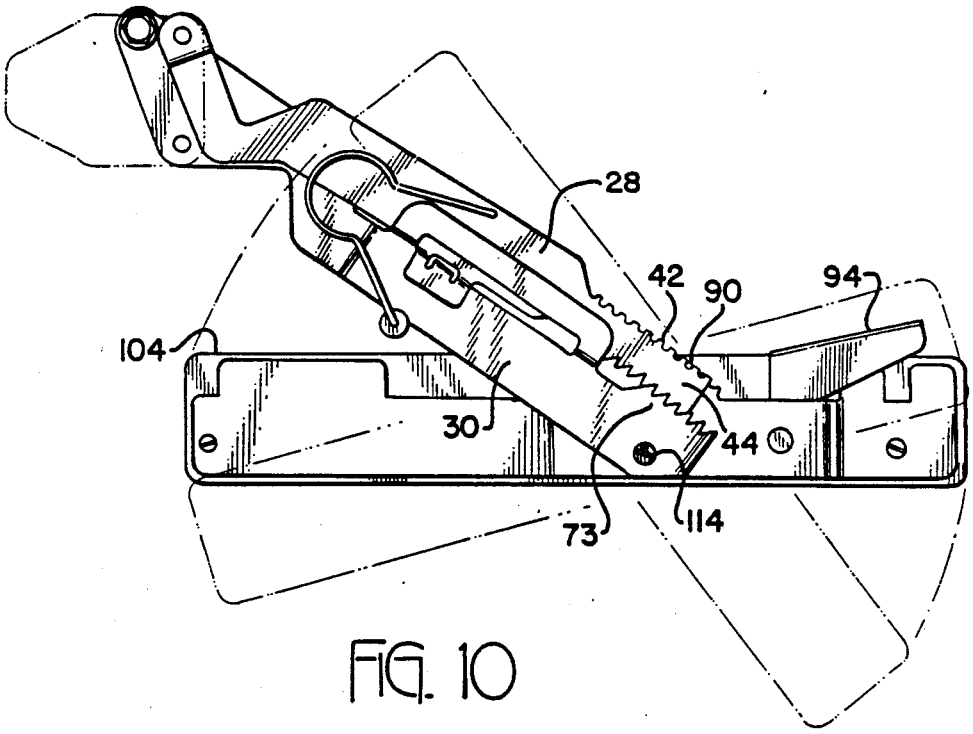
FIG. 10 is a view showing the drawer in the down position with limits of rotation shown in phantom line.

Referring to FIGS. 9 and 10, it is shown that the keyboard support surface 104 can also be rotatably adjusted relative to arms 28,30 into alternative angular attitudes to suit the comfort of the operator. Such angular repositionment is effected in the manner described above with regard to FIG. 7. Namely, the connection between the third arm 78 and the lower arm 30, being pivotal about screw 114, facilitates an angular adjustment of the support surface 104 which is connected to arm 78. Disengagement of meshing teeth 42,90 between arms 28,78 is caused by upward engagement between lever surface 96 and the bottom edge of flange 40. So disengaged. the arm 78 is free to pivot relative to arm 28, and arm 30 to which it is pivotally connected. Release of the actuation lever causes spring 50 to bring arms 28,30 together which likewise brings arms 28,78 back into meshing engagement. The keyboard surface 104 resultantly is locked into its new angular attitude.

FIGS. 9 and 10 illustrate that the angular repositionment of surface 104 can occur at any vertical position of arms 28,30 relative to the housing. Also, because of the relatively long length of meshing teeth racks 42,90, the angular adjustment can range plus or minus twenty-five degrees from horizontal.

From FIGS. 1 and 2, the advantages of the present invention will be readily recognized. The arms 28,30 are stored within housing 4 (FIG. 3) until the operator wishes access to the keyboard. Extension of arms 28,30 brings the keyboard support surface 104 out the full limit of the guide tracks 16, at which point the surface 104 is horizontal. The operator thereafter can effect simultaneous vertical and angular adjustment of the surface 104 by downward depression of the levers 94 at outward corners of surface 104. Resultantly, meshing gear arrangements between the arms 28,30, and 78 are released, enabling pivotal movement of arms 28,30 in the vertical direction, and angular rotation of arm 78 relative to arm 30 and arm 28. Release of the levers 94 automatically re-establishes the locking engagement between corresponding racks of teeth by spring 50 drawing arms 28,30 together. The subject assembly is self-locking in the downward direction and self-releasing in the upward direction, whereby safety to the operator is enhanced.

While the above describes the preferred embodiment of the present invention, the scope of the subject invention is not to be so restricted. Other embodiments, or other applications of the above described mechanism for effectuating arcuate and angular repositionment of a surface, which utilize the teachings herein set forth, are intended to be within the scope and spirit of the subject invention.

I claim:

1. An adjustable keyboard supporting assembly, comprising:

a. housing means;

b. upper first and lower second arm means having first ends pivotally connected to said housing means at respective pivot points and having second free ends extending from said housing means into distal proximity and pivoting about respective horizontal axis extending through said respective pivot points;

c. keyboard support surface means;

d. third arm means fixedly connected to said support surface means and pivotally connected to said second arm means, thereby said keyboard support surface means rotates about a horizontal axis into alternative angular dispositions and is pivotally repositionable with respect to said second arm means;

e. engagement means on said free ends of said first and second arm means and said third arm means for bringing said arm means into locking engagement, whereby inhibiting said pivotal and rotational movement of said keyboard support surface means when engaged and for allowing pivotal and rotational movement of said keyboard support means when not engaged.

2. An adjustable keyboard supporting assembly according to claim 1, said engagement means self-locking to inhibit downward pivotal movement of said keyboard support surface means and self-releasing to facilitate free upward pivotal movement of said keyboard support surface means.

3. An assembly according to claim 2, said engagement means including pivot locking means for inhibiting said pivotal movement of said first and second arm means, rotation locking means for inhibiting said rotational movement of said keyboard support surface means, and actuation means for simultaneously releasing said pivot locking means and rotation locking means, whereby enabling simultaneous rotational and pivotal repositionment of said keyboard support surface means.

4. An assembly according to claim 3, said rotation locking means comprising meshing racks of teeth extending along opposing segments of said first and third arm means.

5. An assembly according to claim 4, said pivot locking means comprising meshing racks of teeth extending along opposing segements of said first and second arm means.

6. An assembly according to claim 5, said actuation means comprising a plate member pivotally mounted to said third arm means and adapted to pivotally engage said first arm means to simultaneously disengage said pivot and said rotation locking means.

7. An assembly according to claim 6 or claim 1, said first and second arm means being further mounted to carriage means receiveable into said housing means, whereby said arm means being moveable between a storage position within said housing means and an extended position substantially forward of said housing means.

* * * * *